United States Patent [19]

Huddleston

[11] 3,992,906

[45] Nov. 23, 1976

[54] WHEEL LOCK FOR MOTORCYCLES AND THE LIKE

[76] Inventor: Lewis E. Huddleston, 7110 Denton, Belleville, Mich. 48111

[22] Filed: May 15, 1972

[21] Appl. No.: 253,626

[52] U.S. Cl. ..... 70/18; 70/39

[51] Int. Cl.[2] ..... E05B 73/00

[58] Field of Search ..... 70/18, 20, 23, 32–34, 70/39, 57–58, 225–227, 233, 23 L, 14, 15

[56] References Cited

UNITED STATES PATENTS

| | | | |
|---|---|---|---|
| 947,073 | 1/1910 | Conta | 70/236 |
| 1,671,602 | 5/1928 | Morris | 70/18 |
| 1,741,391 | 12/1929 | Wise | 70/32 |
| 1,971,797 | 8/1934 | Shinn | 70/32 |
| 2,999,377 | 9/1961 | Raye | 70/32 |
| 3,664,164 | 5/1972 | Zaidener | 70/202 |

*Primary Examiner*—Robert L. Wolfe
*Attorney, Agent, or Firm*—Robert G. Mentag

[57] ABSTRACT

A lock, for use on motorcycles, bicycles, truck vans and the like, and which comprises a U-shaped shackle member having a long arm and a short arm. A releasable locking arm is adapted to be releasably locked to said long arm by a cylinder lock means, and in a position parallel to said long arm and in alignment with said short arm.

6 Claims, 9 Drawing Figures

WHEEL LOCK FOR MOTORCYCLES AND THE LIKE

SUMMARY OF THE INVENTION

This invention relates to the lock art, and in particular to a lock adapted for use on motorcycles, bicycles, truck vans and the like.

It is the primary object of the present invention to provide a novel and improved lock that is particularly adapted for use on motorcycles, bicycles, truck vans and the like, for the purpose of preventing theft or unauthorized use of such vehicles. The lock can be used in many different positions on a motorcycle or a bicycle. It can be used in transverse positions for locking the front and rear wheels to their respective shocks, or it can be used in longitudinal positions for locking either of the wheels to the frame of the vehicle.

It is another object of the present invention to provide a novel and improved lock for motorcycles, bicycles, truck vans and the like which is simple and compact in construction, economical to manufacture and efficient in use.

It is still another object of the present invention to provide a novel and improved lock for a motorcycle, bicycle, truck van and the like, which may be easily and conveniently stored on the vehicle with which it is to be used.

It is still a further object of the present invention to provide a novel and improved vehicle lock which includes a shackle member having a long arm, and a short arm which is laterally spaced apart from said long arm, a releasable locking arm, and means for releasably locking said releasable locking arm to said long arm and in a position parallel to said long arm and in alignment with said short arm.

Other objects, features and advantages of this invention will be apparent from the following detailed description, appended claims, and the accompanying drawing.

DESCRIPTION OF THE PREFERRED EMBODIMENTS

Figure 1:
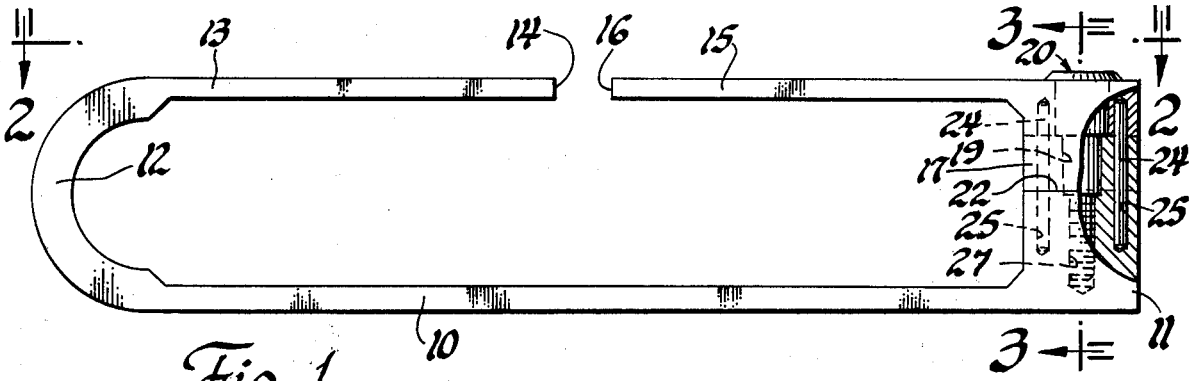
FIG. 1 is a side elevational view, with parts broken away and parts in section, of a lock made in accordance with the principles of the invention.

Referring now to the drawing, and in particular to FIG. 1, wherein is illustrated a first embodiment of the invention, the numeral 10 designates the long arm of a U-shaped shackle member. On one end of the shackle arm 10 there is provided a transverse, inwardly extended, integral lock head or block 11. The other end of the shackle arm 10 is integrally connected to one end of a transverse inwardly extended U-shaped bight portion or connecting arm 12. Integrally connected to the other end of the shackle bight portion 12 is a second and short shackle arm 13 which has a free end indicated by the numeral 14. It will be seen from FIG. 1 that the arms 10 and 13 are of unequal length and they are laterally spaced apart, and that the arm 10 extends longitudinally beyond the free end 14 of the arm 13.

Figure 2:
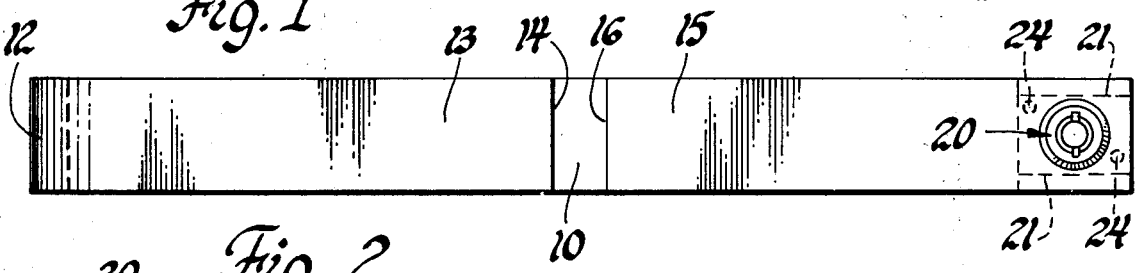
FIG. 2 is a top plan view of the lock structure illustrated in FIG. 1, taken along the line 2—2 thereof, and looking in the direction of the arrows.

As shown in FIGS. 1 and 2, the lock of the present invention also includes a releasable locking arm 15 which has a free end 16 spaced apart from the free end 14 of the shackle arm 13. The locking arm 15 is disposed parallel to the shackle arm 10 and in alignment with the shackle arm 13. The free end 16 of the locking arm 15 is spaced apart from the end 14 of the shackle arm 13 by a suitable gap or distance, as for example, in one embodiment the gap between these arm ends was about ¾ inch. The outer end of the releasable locking arm is provided with an integral, transverse inwardly extended short lock head or block 17 which is lockingly engaged with the block 11 on arm 10, and which is releasably secured thereto by a suitable cylinder block generally indicated by the numeral 20.

Figure 3:
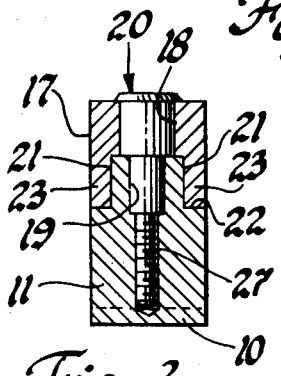
FIG. 3 is an elevational section view of the lock structure illustrated in FIG. 1, taken along the line 3—3 thereof, and looking in the direction of the arrows.

As best seen in FIG. 3, the inner end of the block 11 is cut away on the outer sides thereof to provide a reduced inner end or tongue portion having the inwardly disposed sidewalls 21 which terminate at the shoulders 22. The short head or block 17 on the arm 15 is provided with a channel shaped slot formed longitudinally through the inner end thereof so as to provide two spaced apart flanges 23 which are seated over the reduced inner end of the block 11. The flanges 23 have their inner ends seated on the shoulders 22 to provide a tongue and groove interlocking structure between the blocks 11 and 17.

As shown in FIGS. 1 and 2, the blocks 11 and 17 are further interconnected, when they are in the locking position shown in FIGS. 1 and 2, by a pair of transversely disposed retainer pins 24. One end of each of the retainer pins 24 is press fitted in a suitable hole in the block 17, and the other end is adapted to be slidably mounted in a suitable hole 25 in the block 11 when the releasable locking arm 15 is mounted in its locked position, as shown in FIGS. 1, 2 and 3. The pins 24 are disposed on diametrical opposite sides of the cylinder lock 20.

The cylinder lock 20 may be of any suitable conventional screw type, key actuated cylinder lock construction, as for example, the screw type key actuated cylinder locks employed in conventional vending machines. The cylinder lock 20 is illustrated as having a body with a stepped outer diameter construction and with an inner threaded end. However, it will be understood that other types of conventional cylinder locks may be employed, as for example, cylinder locks that may have other outer configurations than that illustrated in FIGS. 1 and 3.

As best seen in FIG. 3, the cylinder lock 20 has a stepped outer diameter body construction which extends through a first bore 18 in the block 17, a second reduced diameter bore 19 in the block 11, and into an inner threaded reduced diameter bore 27 in the block 11. The cylinder lock 20 operates in a conventional manner. The key for the cylinder lock 20 is inserted into the outer end of the cylinder lock and the cylinder lock may then be disposed in the aforementioned holes 18, 19 and 27. The inner threaded end of the cylinder lock 20 is threaded inwardly into the threaded bore 27 so as to lock the block 17 onto the block 11 on the arm 10.

The embodiment of FIGS. 1, 2 and 3 is illustrated as being made from flat bar stock with the bight portion 12 of the shackle member being provided with a larger cross section for strength purposes. However, it will be understood that other suitable cross sectional shapes may be employed for forming the various parts of the lock. The shackle member and releasable locking arm 15, together with the blocks 11 and 17, are made from a suitable steel, as for example, a No. 1020 steel which is hot rolled and is of a low carbon content, and which is also case hardened to a desirable depth, as for example to 0.008 inch. If desired, the outer surface of the shackle member and the arm 15 may be covered with a suitable plastic or rubber.

In use, the lock of the present invention may be mounted in a locking position in various places on a motorcycle. For example, with the releasable locking arm 15 detached from the shackle member, the shackle member may be mounted transversely through the spokes of a motorcycle front wheel and around the front fork or shocks. After the shackle member is mounted in position, the releasable locking arm 15 is then securely locked to the shackle member. The lock of the present invention may also be mounted transversely through the spokes of the rear wheel and around the rear shocks. It could also be mounted longitudinally between the front fork and the front part of the frame of the motorcycle. It could also be mounted longitudinally between the rear part of the motorcycle frame and the rear shocks.

It will be understood that the lock of the present invention may be made to any desired size. For example, the lock may be made as a small lock wherein the arms 10, 13 and 15 are reduced in length so as to provide a small size lock adapted for locking truck doors. Small size locks of the present invention may also be used on bicycles.

Figure 4:
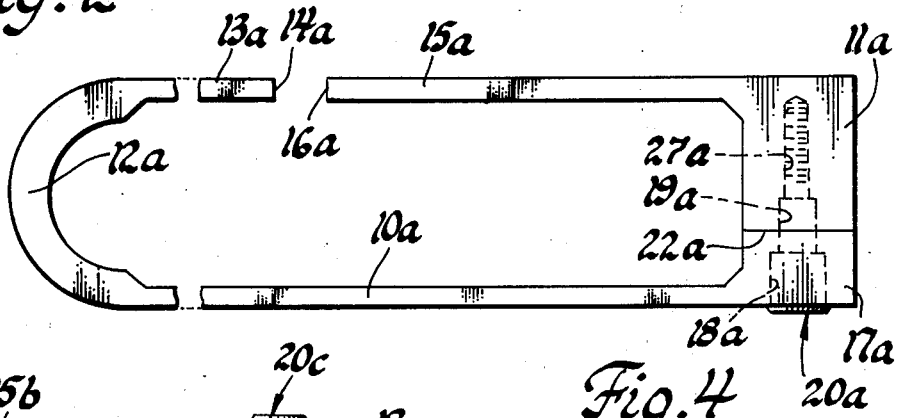
FIG. 4 is a broken, side elevational view of a second embodiment of the invention.

FIG. 4 is a broken, side elevational view of a modified embodiment of the invention. The structure of the embodiment of FIG. 4 which is the same as that of the embodiment of FIGS. 1 through 3, has been marked with the same letters followed by the small letter *a*. The only difference between the embodiments of FIGS. 1 through 3, and FIG. 4, is that the longer lock head or block 11*a* is integrally formed on the releasable locking head 15a instead of on the shackle arm 10*a*.

Figure 5:
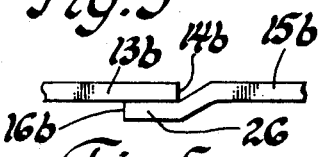
FIG. 5 is a fragmentary, side elevational view of a modification of the embodiments of FIGS. 1 and 4.

FIG. 5 illustrates a modification of the structure of the embodiments of FIGS. 1 through 3, and FIG. 4, wherein, in the embodiment of FIG. 5, the releasable locking arm 15 has its free end extended longitudinally toward the bight portion of the shackle member and it is bent inwardly and under the free end 14*b* of the arm 13*b* so as to provide an overlapping free end 26 that is slidably mounted under and in engagement with the free end of the shackle arm 13*b*. A lock provided with such an overlapping arm end structure would be especially adapted for use on truck vans, although it could also be used on motorcycles and bicycles.

Figure 8:
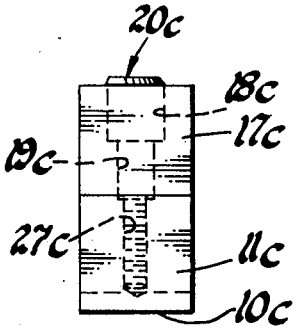
FIG. 8 is a right side elevational view of the structure illustrated in FIG. 6, taken along the line 8—8 thereof, and looking in the direction of the arrows.
Figure 6:
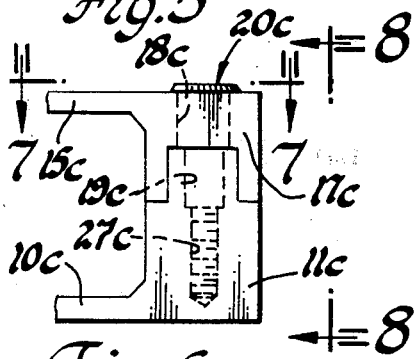
FIG. 6 is a fragmentary, side elevational view of a third embodiment of the invention.
Figure 9:
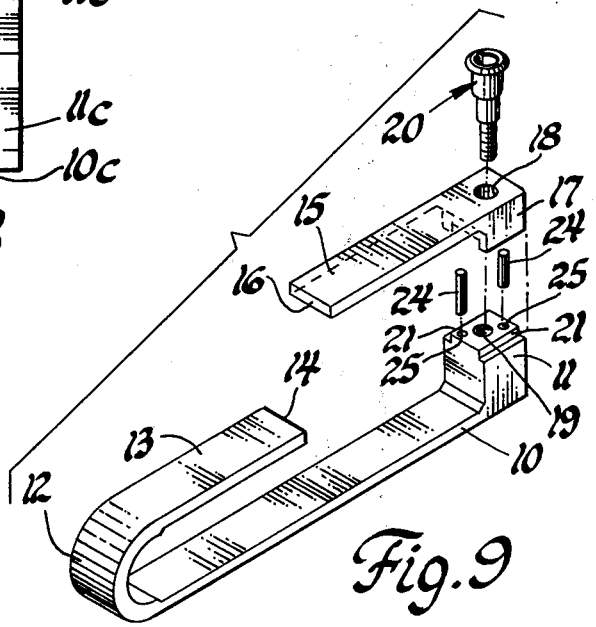
FIG. 9 is a perspective, exploded view of the first embodiment of FIGS. 1 through 3.
Figure 7:
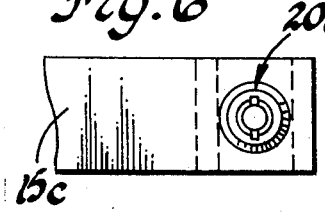
FIG. 7 is a fragmentary, top plan view of the structure illustrated in FIG. 6, taken along the line 7—7 thereof, and looking in the direction of the arrows.

FIGS. 6, 7 and 8 illustrate a further embodiment of the invention, and the parts of the structure of FIGS. 6, 7 and 8 which are the same as the first embodiment of FIGS. 1, 2 and 3, have been marked with the same reference numerals followed by the small letter *c*. The only difference between the embodiment of FIGS. 6, 7 and 8 and that of FIGS. 1, 2 and 3 is that the tongue and groove interconnecting structure between the blocks 11*c* and 17*c* is formed in a transverse direction as compared to the longitudinal direction in the structure of FIGS. 1, 2 and 3.

While it will be apparent that the preferred embodiments of the invention herein disclosed are well calculated to fulfill the objects above stated, it will be appreciated that the invention is susceptible to modification, variation and change.

What is claimed is:

1. In a lock, the combination comprising:

a. a U-shaped shackle member having a long arm and a short arm which is aligned parallel with and laterally spaced apart from said long arm by an integral transverse connecting arm;

b. a releasable locking arm;

c. means for releasably locking said releasable locking arm to said long arm, and in a position parallel to said long arm and in longitudinal alignment with said short arm, including 1. a first lock head fixedly secured to said long arm;
2. a second lock head fixedly secured to said releasable locking arm; and,
3. a cylinder lock means releasably securing said lock heads together to releasably attach said releasable locking arm to said shackle member.

2. The lock structure as defined in claim 1, wherein:

a. one of said lock heads is provided with a pair of retainer pins which are fixedly secured thereto at one of their ends; and, b. the other of said lock heads is provided with a pair of suitable bores for receiving the other ends of said retainer pins.

3. The lock structure as defined in claim 1, wherein:

a. said lock heads have inner ends which are formed with interconnecting shapes for inter-engagement with each other when the lock heads are secured together by said cylinder lock means.

4. The lock structure as defined in claim 3, wherein:

a. said interconnecting shapes on the inner ends of said lock heads include a tongue formed on the inner end of one of the lock heads and a mating groove formed on the inner end of the other lock head.

5. The lock structure as defined in claim 4, wherein:

a. said tongue and said groove are each formed transversely of the longitudinal direction of the shackle member and releasable locking arm.

6. The lock structure as defined in claim 4, wherein:

a. said tongue and said groove are each formed longitudinally of the shackle member and releasable locking arm.

* * * * *